US011277699B2

(12) United States Patent
Sacha et al.

(10) Patent No.: US 11,277,699 B2
(45) **Date of Patent: *Mar. 15, 2022**

(54) HYBRID SHELL FOR HEARING AID

(71) Applicant: Starkey Laboratories, Inc., Eden Prairie, MN (US)

(72) Inventors: Michael Karl Sacha, Chanhassen, MN (US); Jay Stewart, Eden Prairie, MN (US); Wes Gentry, Buffalo, MN (US); Craig Feldsien, Prior Lake, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 214 days.

This patent is subject to a terminal disclaimer.

(21) Appl. No.: 16/551,343

(22) Filed: Aug. 26, 2019

(65) Prior Publication Data

US 2020/0120432 A1 Apr. 16, 2020

Related U.S. Application Data

(63) Continuation of application No. 15/280,997, filed on Sep. 29, 2016, now Pat. No. 10,397,714.

(60) Provisional application No. 62/235,888, filed on Oct. 1, 2015.

(51) Int. Cl.
*H04R 25/00* (2006.01)

(52) U.S. Cl.
CPC ..... *H04R 25/658* (2013.01); *H04R 25/652* (2013.01); *H04R 2225/023* (2013.01); *H04R 2225/025* (2013.01); *H04R 2225/77* (2013.01)

(58) Field of Classification Search
CPC ..... H04R 25/658; H04R 25/652; H04R 2225/023; H04R 2225/025; H04R 2225/77; H04R 25/65; H04R 2225/021
See application file for complete search history.

(56) References Cited

U.S. PATENT DOCUMENTS

| | | | | |
|---|---|---|---|---|
| 6,167,141 | A | 12/2000 | Yoest | |
| 6,393,130 | B1 | 5/2002 | Stonikas et al. | |
| 7,130,437 | B2 | 10/2006 | Stonikas et al. | |
| 7,875,223 | B2 | 1/2011 | Masters | |
| 8,670,067 | B2 | 3/2014 | Naito | |
| 9,774,962 | B2 | 9/2017 | Karamuk et al. | |
| 10,397,714 | B2 * | 8/2019 | Sacha | H04R 25/658 |
| 2003/0221902 | A1 | 12/2003 | Stinauer et al. | |

(Continued)

FOREIGN PATENT DOCUMENTS

| | | | |
|---|---|---|---|
| EP | 2497278 | B1 | 1/2015 |

OTHER PUBLICATIONS

"U.S. Appl. No. 15/280,997, 312 Amendment filed Jul. 3, 2019", 2 pgs.

(Continued)

*Primary Examiner* — Amir H Etesam
(74) *Attorney, Agent, or Firm* — Schwegman Lundberg & Woessner, P.A.

(57) ABSTRACT

A method is a described for constructing a hearing aid shell that comprises a combination of hard and soft materials. In one embodiment, 3D printing is combined with conventional mold/casting methods so that a first shell portion made of a hard material and a mold for a second shell portion are 3D printed. The mold is then filled with a soft material which is allowed to set to form the second shell portion, and the first and second shell portions are adhesively attached.

20 Claims, 5 Drawing Sheets

(56) References Cited

U.S. PATENT DOCUMENTS

| | | | | |
|---|---|---|---|---|
| 2009/0189313 | A1* | 7/2009 | Masters | H04R 25/60 264/328.1 |
| 2011/0068502 | A1 | 3/2011 | Basseas | |
| 2011/0182451 | A1 | 7/2011 | Vaarbroe et al. | |
| 2011/0271965 | A1 | 11/2011 | Parkins et al. | |
| 2012/0224734 | A1 | 9/2012 | Cohen | |
| 2016/0183018 | A1 | 6/2016 | Spearman et al. | |
| 2017/0099553 | A1 | 4/2017 | Sacha et al. | |

OTHER PUBLICATIONS

"U.S. Appl. No. 15/280,997, Advisory Action dated Aug. 3, 2018", 4 pgs.
"U.S. Appl. No. 15/280,997, Appeal Brief filed Oct. 31, 2018", 14 pgs.
"U.S. Appl. No. 15/280,997, Final Office Action dated Apr. 2, 2018", 8 pgs.
"U.S. Appl. No. 15/280,997, Non Final Office Action dated Sep. 8, 2017", 8 pgs.
"U.S. Appl. No. 15/280,997, Notice of Allowance dated Apr. 10, 2019", 10 pgs.
"U.S. Appl. No. 15/280,997, Notification of Non-Compliant Appeal Brief mailed Nov. 29, 2018", 2 Pgs.
"U.S. Appl. No. 15/280,997, PTO Response to Rule 312 Communication dated Jul. 22, 2019", 2 pgs.
"U.S. Appl. No. 15/280,997, Response filed Jun. 4, 2018 to Final Office Action dated Apr. 2, 2018", 6 pgs.
"U.S. Appl. No. 15/280,997, Response filed Dec. 8, 2017 to Non Final Office Action dated Sep. 8, 2017", 6 pgs.
"U.S. Appl. No. 15/280,997, Response filed Dec. 28, 2018 to Notification of Non-Compliant Appeal Brief mailed Nov. 29, 2018", 6 pgs.
"European Application Serial No. 16191983.2, Communication Pursuant to Article 94(3) EPC dated Mar. 8, 2018", 6 pgs.
"European Application Serial No. 16191983.2, Extended European Search Report dated Feb. 21, 2017", 8 pgs.
"European Application Serial No. 16191983.2, Response filed Jan. 25, 2018 to Communication pursuant to Rule 112(1) dated Nov. 15, 2017", 12 pgs.
U.S Appl. No. 15/280,997 U.S. Pat. No. 10,397,714, filed Sep. 29, 2016, Hybrid Shell for Hearing Aid.

* cited by examiner

HYBRID SHELL FOR HEARING AID

CROSS-REFERENCE TO RELATED APPLICATION

This patent application is a continuation of U.S. patent application Ser. No. 15/280,997, filed on Sep. 29, 2016, now issued as U.S. Pat. No. 10,397,714, which claims the benefit of U.S. Provisional Patent Application No. 62/235,888, filed Sep. 29, 2016, which is incorporated by reference herein in its entirety.

FIELD OF THE INVENTION

This invention pertains to electronic heating aids and methods for their construction.

BACKGROUND

Hearing aids are electronic instruments that compensate for hearing losses by amplifying sound. The electronic components of a hearing aid include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. In certain types of hearing aids, the electronic components are enclosed by housing that is designed to be worn in the ear for both aesthetic and functional reasons. Such devices may be referred to as in-the-ear (ITE), in-the-canal (ITC), completely-in-the-canal (CIC) type, or invisible-in-the-canal (HC) hearing aids. Other types of heating aids, referred to as receiver-in-canal (RIC) hearing aids, include a receiver housing that is worn in the ear.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1:
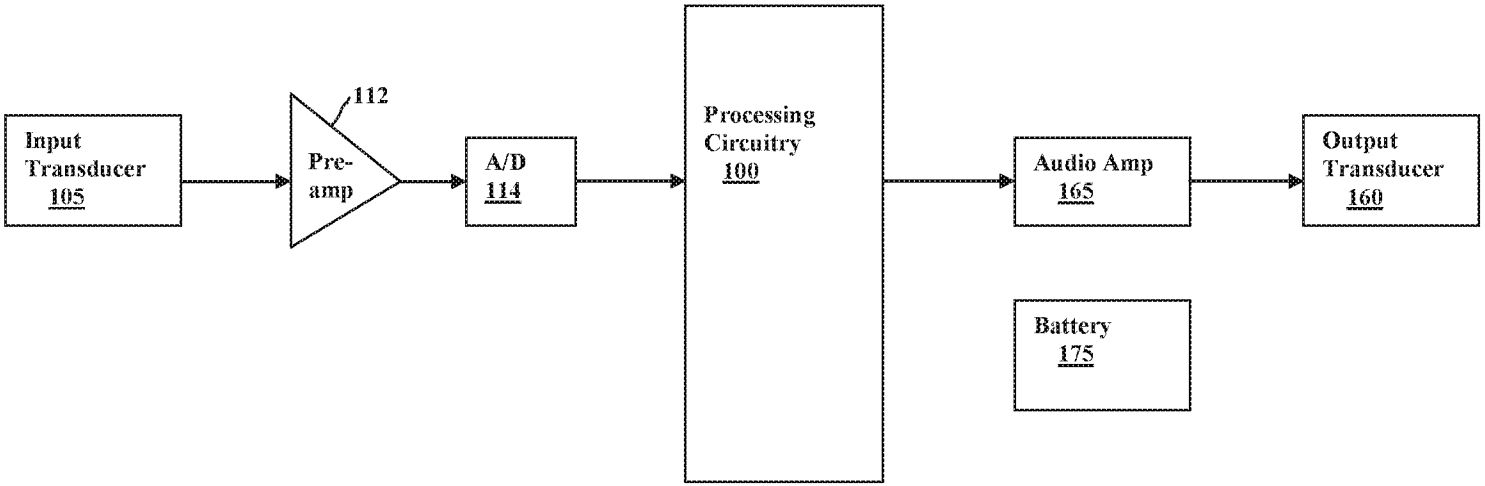
FIG. 1 shows the basic electronic components of an example hearing aid.

FIG. 1 illustrates the basic functional components of an example hearing aid. The electronic circuitry of a typical hearing aid is contained within a housing that is commonly either placed in the external ear canal or behind the ear. A microphone or other input transducer 105 receives sound waves from the environment and converts the sound into an input signal. After amplification by pre-amplifier 112, the input signal is sampled and digitized by A/D converter 114 to result in a digitized input signal. The device's processing circuitry 100 processes the digitized input signal into an output signal in a manner that compensates for the patient's hearing deficit. The output signal is then passed to an audio amplifier 165 that drives an output transducer 160 or receiver for converting the output signal into an audio output. A battery 175 supplies power for the electronic components.

Figure 2:
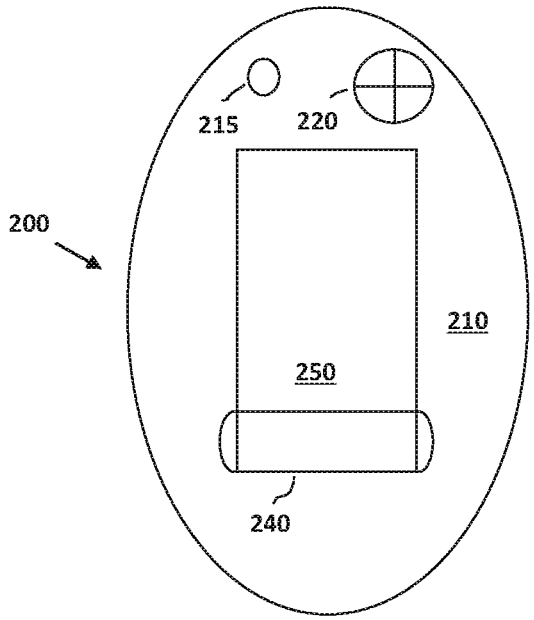
FIG. 2 shows a top view of the housing of an example hearing aid.
Figure 3:
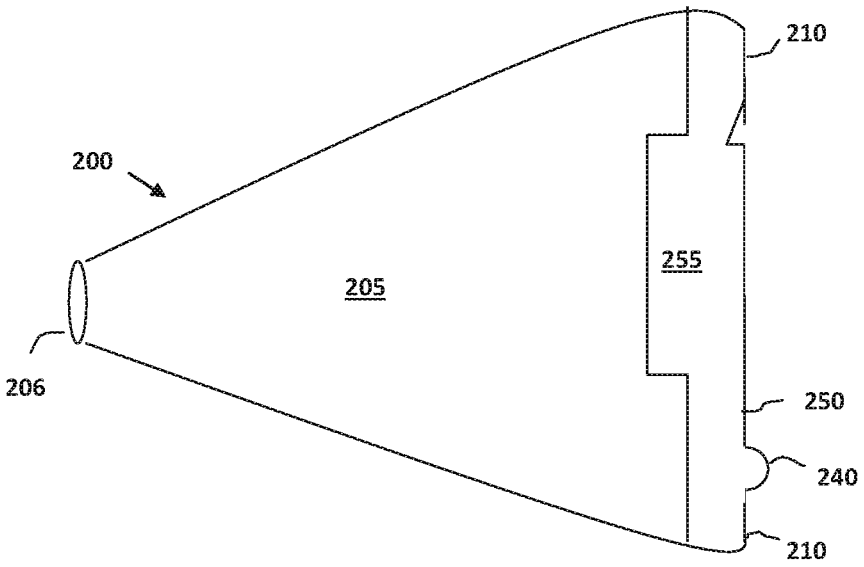
FIG. 3 depicts a cross-sectional view of the housing shown in FIG. 2.

FIGS. 2 and 3 show a top view and a cross-sectional side view, respectively, of an example housing or enclosure 200 for a hearing aid. The cross-section of FIG. 3 is taken vertically through approximately the middle of FIG. 2. The enclosure is made up of an ear mold or shell 205, within which are housed the electronic components the electronic components described above with reference to FIG. 1, and a faceplate 210. At the end of the ear mold opposite the faceplate is an outlet port 206 for the receiver to convey sound to the wearer's ear. The faceplate includes a status indicator light 215 and a microphone inlet port 220. Also hingedly mounted on the faceplate via hinge 240 is a battery door 250 that opens into a battery compartment 255 to allow replacement of the battery 175.

As the shell 205 of a CIC or ITE type hearing aid is worn in a patient's external ear canal, such shells may be custom made in order to increase patient comfort when the hearing aid is worn for extended periods of time. Previous manufacturing techniques, however, have typically still resulted in patient dissatisfaction that cause the custom shell to be returned. The high return rates associated with custom shells frustrate the end user and cost the manufacturer valuable resources to correct the problems. The high return rates are generally associated with shell discomfort due to pressure points, skin irritation, or skin abrasion.

Manufacturers have tried unsuccessfully to use soft silicone in the shell tip region as a way to increase shell comfort. Due to yellowing of silicone and adhesion issues, this solution is not routinely offered. Also, efficient construction methods have not existed to enable uniform hard/soft material wall thickness. Described herein is a manufacturing solution that overcomes prior solution shortcomings. New junction interface schemes are described that enhance the robustness of hard/soft material interfaces and creates a more comfortable custom shell device that is free of tissue irritation.

This disclosure describes how to create a hard/soft material combination hearing aid shell. A hybrid approach is used where 3D printing (three-dimensional printing, also sometimes referred to as additive manufacturing), is combined with conventional mold/casting methods. Using a hybrid approach enables hard/soft bio-compatible material shells to be constructed without the difficulties associated with the 3D printing of soft biocompatible materials. Using a hybrid approach to create the hard/soft material areas enables the hard/soft material areas to be of uniform thickness, if desired.

Figure 4A:
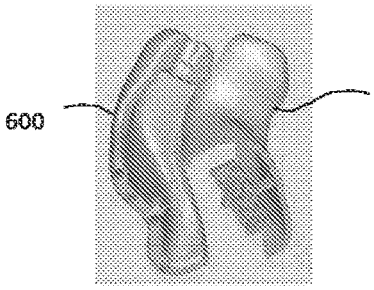
FIGS. 4A-4C illustrate a 3D printed first shell portion made of a hard material, a printed mold, and a casted second shell portion.
Figure 4B:
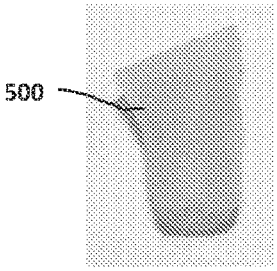
Figure 4C:
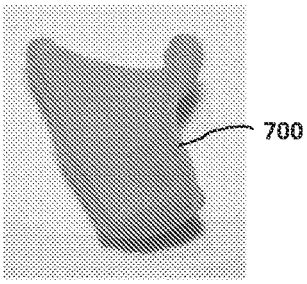

The described method uses established 3D printed materials in a unique way. If a shell is to be printed with hard/soft materials, the hard material area is printed in the customary manner. The area intended for soft material is printed separately, and in a way that a mold is printed that conforms to the canal shape. This mold is flooded by silicone (or other suitable material) and allowed to set. The mold edge is then exposed, allowing access to the silicone/shell interface. Primer and adhesives are applied to one or both edges (i.e., shell edge and silicone edge). The two shell parts are then pressed together. Printed on the shell parts are locating/alignment features that assure the two shell parts fit together. FIGS. 4A through 4C illustrate a 3D printed first shell portion 500 made of a hard material, a printed mold 600, and a casted second shell portion 700. In some embodiments, the second shell portion may be made of transparent silicone.

Figure 5A:
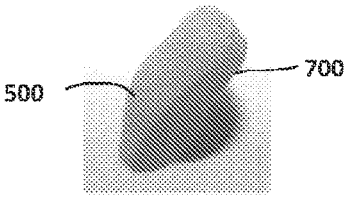
FIGS. 5A-5C illustrate an example of a completed hybrid hearing aid shell.
Figure 5B:
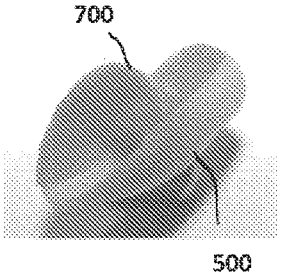
Figure 5C:
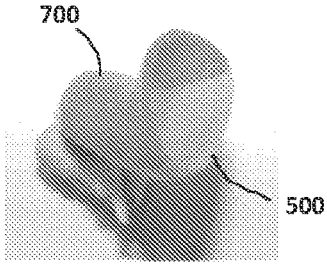

An example of the final shell is illustrated in FIGS. 5A through 5C. Note that the shell is designed such that, when the shell is inserted into the external ear canal of a patient, the soft material shell portion 700 is located on the anterior surface, and the hard shell portion 500 is located of the posterior surface. An important feature of the hybrid shell is the adhesion strength and robustness of the interface. By using appropriate primer and adhesives, this junction may be made very strong.

Figure 6A:
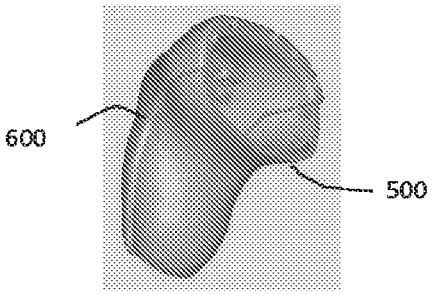
FIGS. 6A-6C illustrate an alternate method for constructing a hybrid shell.
Figure 6B:
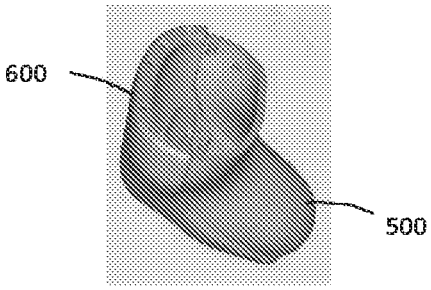
Figure 6C:
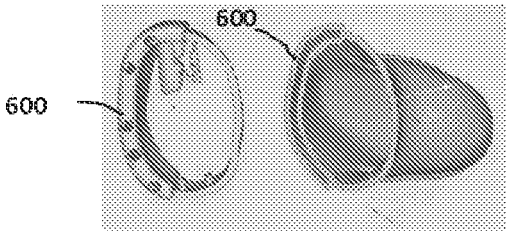
Figure 7:
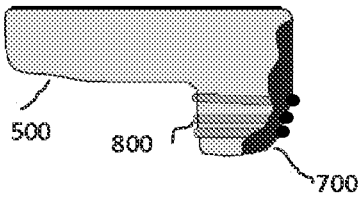
FIG. 7 illustrates the use of sealing rings in the completed shell.

There are other ways of accomplishing the same end result. Illustrated in FIGS. 6A-6C is an alternate method. In this example there is only one 3D printed item/part. The thinner region is the harder shell material 500, and the thicker region is the hollow cast region 600 for the soft material 700. After "pouring" the silicone material into the hollow cast and allowed to set, access is gained to the junction interface between hard/soft materials. Primer and adhesives may be applied by hypodermic needle at the interface and allowed to set. After setting, the mold material may be removed from the hollow cast region 600 exposing the final hard/soft shell structure.

Figure 8A:
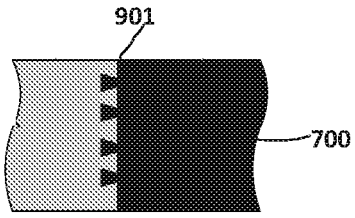
FIGS. 8A-8C illustrate texture features for securing the shell portions together.
Figure 8B:
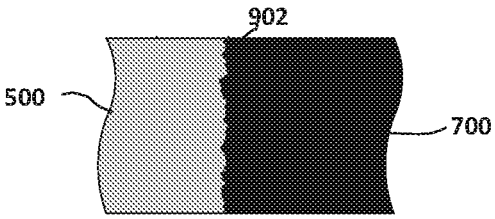
Figure 8C:
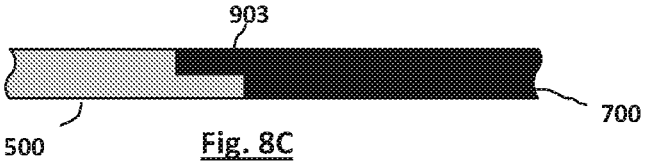

Additionally, rings and texture features may be added as shown in FIG. 7 and FIGS. 8A-8C. These features could transition into the hard shell material, especially for acoustic seal rings. The acoustic seal rings 800 shown in FIG. 7 may help with maintaining an acoustic seal during mandible movement. Textured surfaces as shown in FIGS. 8A-8C aid with shell retention by enabling a stronger attachment after the hard shell and soft shell portions are adhesively attached. FIG. 8A shows an embodiment in which the soft shell portion 500 and the hard shell portion 700 have interlocking portions 901 that both increase the surface area of contact and provide a more secure mechanical connection. FIG. 8B shows an embodiment in the hard shell portion 500 and soft shell portion 700 each have rough and irregular surfaces 902 that increase the surface area of contact. FIG. 8C shows an embodiment in the hard shell portion 500 and soft shell portion 700 have overlapping projections 903 to increase the surface area of contact.

The above figures and accompanying description relate to a shell for a CIC or ITE type of hearing aid. It should be appreciated that the shell constructed as described could also be designed to contain a receiver in an RIC type of hearing aid.

Example Embodiments

In one embodiment, a method for constructing a hearing aid shell comprises: 3D printing a first shell portion made of a hard material; 3D printing a mold for a second shell portion; filling the mold with a soft material which is allowed to set to form the second shell portion; and, adhesively attaching the first and second shell portions. The soft material may be silicone. The method may further comprise 3D printing alignment features to assure that the first and second shell portions fit together.

It is understood that variations in configurations and combinations of components may be employed without departing from the scope of the present subject matter. Hearing assistance devices may typically include an enclosure or housing, a microphone, processing electronics, and a speaker or receiver. The examples set forth herein are intended to be demonstrative and not a limiting or exhaustive depiction of variations.

The present subject matter can be used for a variety of hearing assistance devices, including but not limited to, hearing aids such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for constructing a hearing aid shell, comprising:

3D priming a first shell portion made of a hard material;

3D printing a mold for a second shell portion;

filling the mold with a soft material which is allowed to set to form the second shell portion; and, adhesively attaching the first and second shell portions wherein one of the first or second shell portions forms an anterior surface of the hearing aid shell that contacts an anterior surface of a user's ear canal when the hearing aid shell is inserted therein while the other of first or second shell portions forms a posterior surface of the hearing aid shell that contacts a posterior surface of the user's ear canal when the hearing aid shell is inserted therein.

2. The method of claim 1, wherein the first shell portion forms the posterior surface of the hearing aid shell and the second shell portion forms the anterior surface of the hearing aid shell.

3. The method of claim 1, wherein the soft material is silicone.

4. The method of claim 1, further comprising 3D printing alignment features on the edges of the first and second shell portions to assure that the first and second shell portions fit together.

5. The method of claim 1, further comprising 3D printing textured surfaces on the surfaces of the first and second shell portions that are adhesively attached.

6. The method of claim 5, wherein the textured surfaces of the first and second shell portions increase the surface area of contact between the first and second shell portions.

7. The method of claim 5, wherein the textured surfaces of the first and second shell portions comprise rough and irregular portions that increase the surface area of contact.

8. The method of claim 5, wherein the textured surfaces of the first and second shell portions comprise overlapping portions that increase the surface area of contact.

9. The method of claim 1, further comprising disposing one or more acoustic seal rings around a portion of the hearing aid shell that is adapted to be inserted into a patient's external ear canal.

10. The method of claim 1, further comprising adhering the first shell portion to the soft material in the mold and, after setting, removing the mold.

11. A hearing aid comprising:

a receiver to convert an output signal produced by processing circuitry into an audio output;

a heating aid shell to contain the receiver;

wherein the hearing aid shell is constructed by:

3D printing a first shell portion made of a hard material;

3D printing a mold for a second shell portion;

filling the mold with a soft material which is allowed to set to form the second shell portion; and, adhesively attaching the first and second shell portions wherein one of the first or second shell portions forms an anterior surface of the hearing aid shell that contacts an anterior surface of a user's ear canal when the hearing aid is inserted therein while the other of first or second shell portions forms a posterior surface of the hearing aid shell that contacts a posterior surface of the user's ear canal when the hearing aid is inserted therein.

12. The hearing aid of claim 11, wherein the first shell portion forms the posterior surface of the hearing aid shell and the second shell portion forms the anterior surface of the hearing aid shell.

13. The hearing aid of claim 11, wherein the soft material is silicone.

14. The hearing aid of claim 11, wherein the first and second shell portions further comprise alignment features on the edges of the first and second shell portions to assure that the first and second shell portions fit together.

15. The hearing aid of claim 11, further wherein the first and second shell portions further comprise textured surfaces on the surfaces of the first and second shell portions that are adhesively attached.

16. The hearing aid of claim 15, wherein the textured surfaces of the first and second shell portions increase the surface area of contact between the first and second shell portions.

17. The hearing aid of claim 15, wherein the textured surfaces of the first and second shell portions comprise rough and irregular portions that increase the surface area of contact.

18. The hearing aid of claim 15, wherein the textured surfaces of the first and second shell portions comprise overlapping portions that increase the surface area of contact.

19. The hearing aid of claim 11, further comprising one or more acoustic seal rings disposed around a portion of the hearing aid shell that is adapted to be inserted into a patient's external ear canal.

20. The hearing aid of claim 11, wherein the hearing aid is a completely-in-canal (CIC) hearing aid or receiver-in-canal (RIC) hearing aid.

* * * * *